US011336046B2

(12) United States Patent
Saito et al.

(10) Patent No.: US 11,336,046 B2
(45) Date of Patent: May 17, 2022

(54) CHARGING CONNECTOR

(71) Applicant: YAZAKI CORPORATION, Tokyo (JP)

(72) Inventors: Akihiro Saito, Kakegawa (JP); Tsutomu Sawada, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/167,103

(22) Filed: Feb. 4, 2021

(65) Prior Publication Data

US 2021/0242620 A1 Aug. 5, 2021

(30) Foreign Application Priority Data

Feb. 4, 2020 (JP) ..... JP2020-017193

(51) Int. Cl.
*H01R 13/436* (2006.01)
*H01R 13/502* (2006.01)
*H01R 13/639* (2006.01)

(52) U.S. Cl.
CPC ..... *H01R 13/4361* (2013.01); *H01R 13/502* (2013.01); *H01R 13/639* (2013.01); *H01R 2201/26* (2013.01)

(58) Field of Classification Search
CPC ..... H01R 13/436; H01R 13/4361; H01R 13/4362; H01R 13/4367; H01R 13/4368; H01R 13/502; H01R 13/514
USPC ..... 439/910, 752
See application file for complete search history.

(56) References Cited

U.S. PATENT DOCUMENTS 5,586,917 A 12/1996 Yagi et al.
6,071,153 A 6/2000 Fink et al.
6,283,799 B1 * 9/2001 Fukase ..... H01R 13/4365 439/752
6,341,984 B1 * 1/2002 Murakami ..... H01R 13/5208 439/587
9,472,884 B2 * 10/2016 Kutsuna ..... H01R 13/4362
(Continued)

FOREIGN PATENT DOCUMENTS

EP 2846416 A1 * 3/2015 ..... H01R 13/4223
JP 2000-215941 A 8/2000
(Continued)

*Primary Examiner* — Marcus E Harcum
(74) *Attorney, Agent, or Firm* — Kenealy Vaidya LLP

(57) ABSTRACT

A connector includes a terminal, a housing to accommodate the terminal and a retainer including a locking portion to lock the terminal when the terminal is accommodated in the housing. The housing includes a front housing having a terminal accommodating chamber and a rear housing to be attached to the front housing from a rear side of an insertion direction of the terminal, the rear housing including a lance to, when the terminal is accommodated in the terminal accommodating chamber, lock a rear portion of the terminal. The retainer is to be attached between the front housing and the rear housing and to be displaceable along a direction perpendicular to the insertion direction between a locking position and a non-locking position. The retainer moves from the non-locking position to the locking position and the locking portion locks the rear portion of the terminal in the insertion direction.

4 Claims, 8 Drawing Sheets

(56) References Cited

U.S. PATENT DOCUMENTS

| | | | | |
|---|---|---|---|---|
| 2013/0273764 | A1* | 10/2013 | Kitajima | H01R 13/4362 439/345 |
| 2015/0133002 | A1* | 5/2015 | Gerwatowski | H01R 13/424 439/744 |
| 2018/0342827 | A1* | 11/2018 | Uenosono | H01R 13/436 |
| 2019/0103699 | A1* | 4/2019 | Yamanaka | H01R 13/6581 |
| 2019/0109416 | A1* | 4/2019 | Tsukamoto | H01R 13/6585 |

FOREIGN PATENT DOCUMENTS

| | | | |
|---|---|---|---|
| JP | 2005-166611 | A | 6/2005 |
| JP | 2012-69463 | A | 4/2012 |
| JP | 2018-200791 | A | 12/2018 |

* cited by examiner

CHARGING CONNECTOR

CROSS-REFERENCE TO RELATED APPLICATION

The present application claims priority to Japanese Patent Application No. 2020-017193 filed on Feb. 4, 2020, the entire content of which is incorporated herein by reference.

TECHNICAL FIELD

The present invention relates to a connector.

BACKGROUND

A related art charging connector is attached to a vehicle such as an electric vehicle or a hybrid vehicle. The charging connector includes a housing having a terminal accommodating chamber into which a terminal is inserted from a rear side, a rear holder attached to a rear portion of the housing, and a front holder attached to a front portion of the housing (for example, see JP2018-200791A).

In the connector, the housing is formed with a lance (a housing flexible piece), and the terminal inserted into the terminal accommodating chamber is locked by the lance. When the rear holder is attached to the housing and is brought to a locking state, displacement of the lance is restricted by a retainer of the rear holder, and the terminal is double locked.

In the connector, the housing having the terminal accommodating chamber into which the terminal is inserted and that accommodates the terminal is provided with the lance for locking the terminal. Therefore, a structure of the housing is complicated, which leads to an increase in cost. In addition, it is difficult to reduce a size of the housing due to the complicated structure.

SUMMARY

Illustrative aspects of the present invention provide a connector configured to favorably lock a terminal and reduce cost and size by simplifying a structure.

According to an illustrative aspect of the present invention, a connector includes a terminal, a housing configured to accommodate the terminal and a retainer including a locking portion configured to lock the terminal when the terminal is accommodated in the housing. The housing includes a front housing having a terminal accommodating chamber into which the terminal is configured to be inserted and in which the terminal is to be accommodated and a rear housing configured to be attached to the front housing from a rear side of an insertion direction in which the terminal is inserted into the terminal accommodating chamber, the rear housing including a lance configured to, when the terminal is accommodated in the terminal accommodating chamber, lock a rear portion of the terminal in the insertion direction. The retainer is configured to be attached between the front housing and the rear housing and to be displaceable along a direction perpendicular to the insertion direction between a locking position and a non-locking position. The retainer moves from the non-locking position to the locking position and the locking portion locks the rear portion of the terminal in the insertion direction accommodated in the terminal accommodating chamber.

Other aspects and advantages of the invention will be apparent from the following description, the drawings and the claims.

BRIEF DESCRIPTION OF DRAWINGS

FIG. 7 is a perspective view showing the connector cut along a longitudinal direction and FIGS. 8A and 8B are views showing states of a retainer, in which FIG. 8A is a front view showing a state where the retainer is disposed at a non-locking position as viewed from a rear side of the first connector portion, and in which FIG. 8B is a front view showing a state where the retainer is disposed at a locking position as viewed from the rear side of the first connector portion.

DESCRIPTION OF EMBODIMENTS

Figure 1:
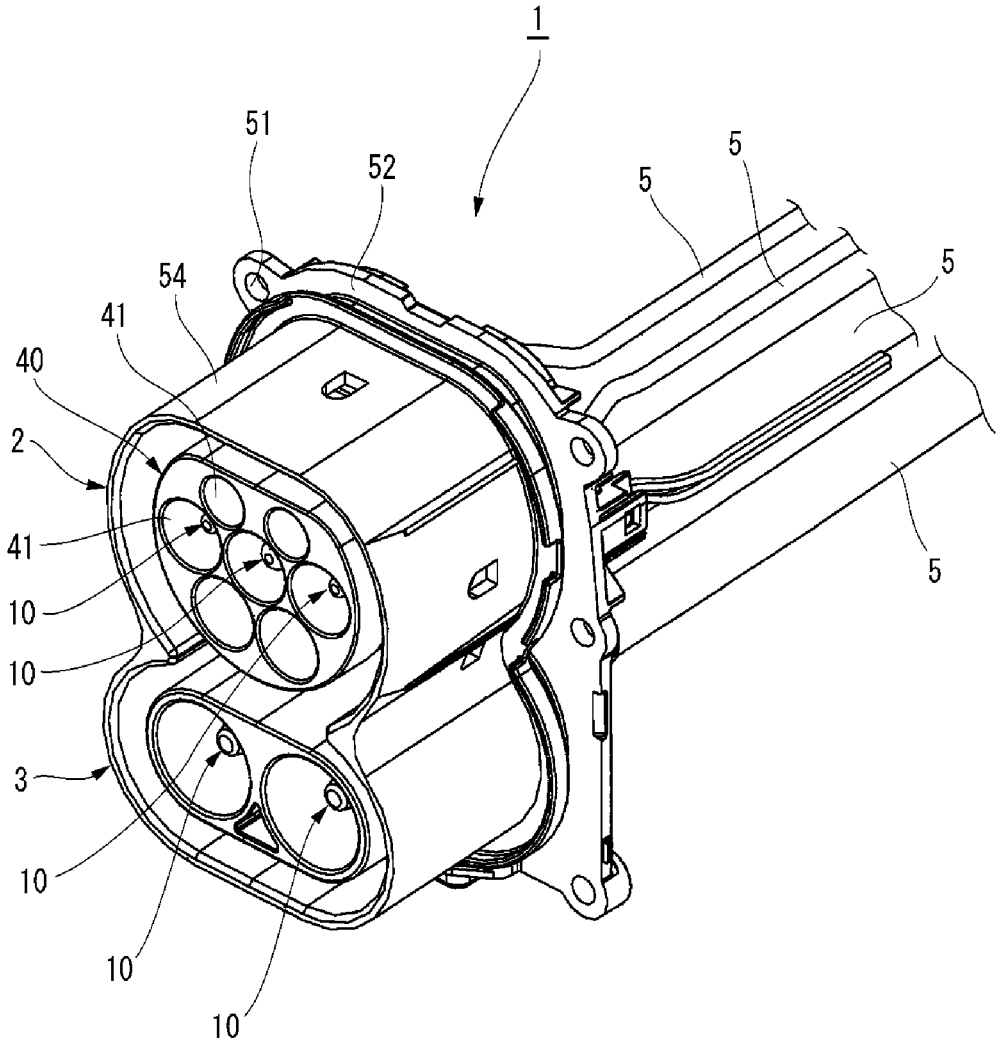
FIG. 1 is a perspective view showing a connector according to an embodiment as viewed from a front side.
Figure 2:
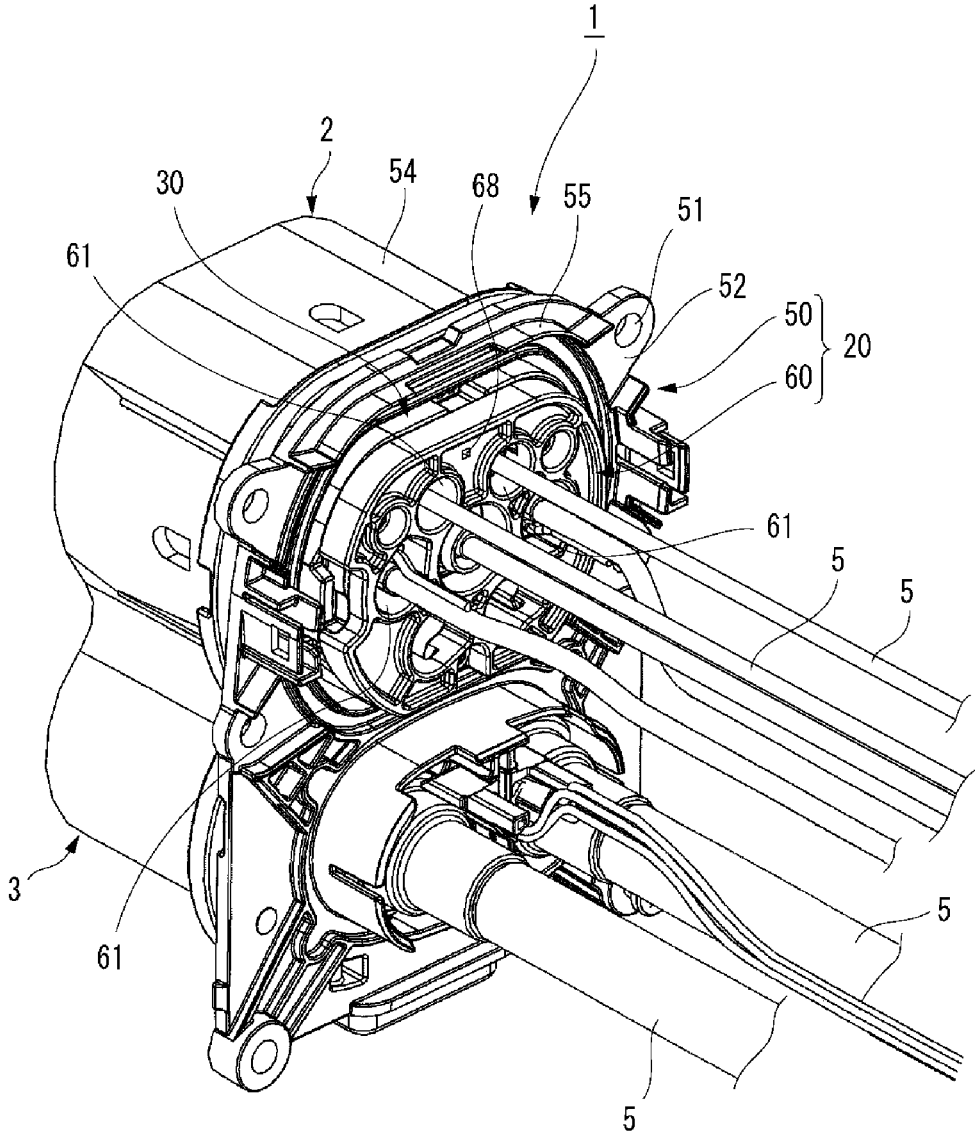
FIG. 2 is a perspective view showing the connector according to the embodiment as viewed from a rear side.
Figure 3:
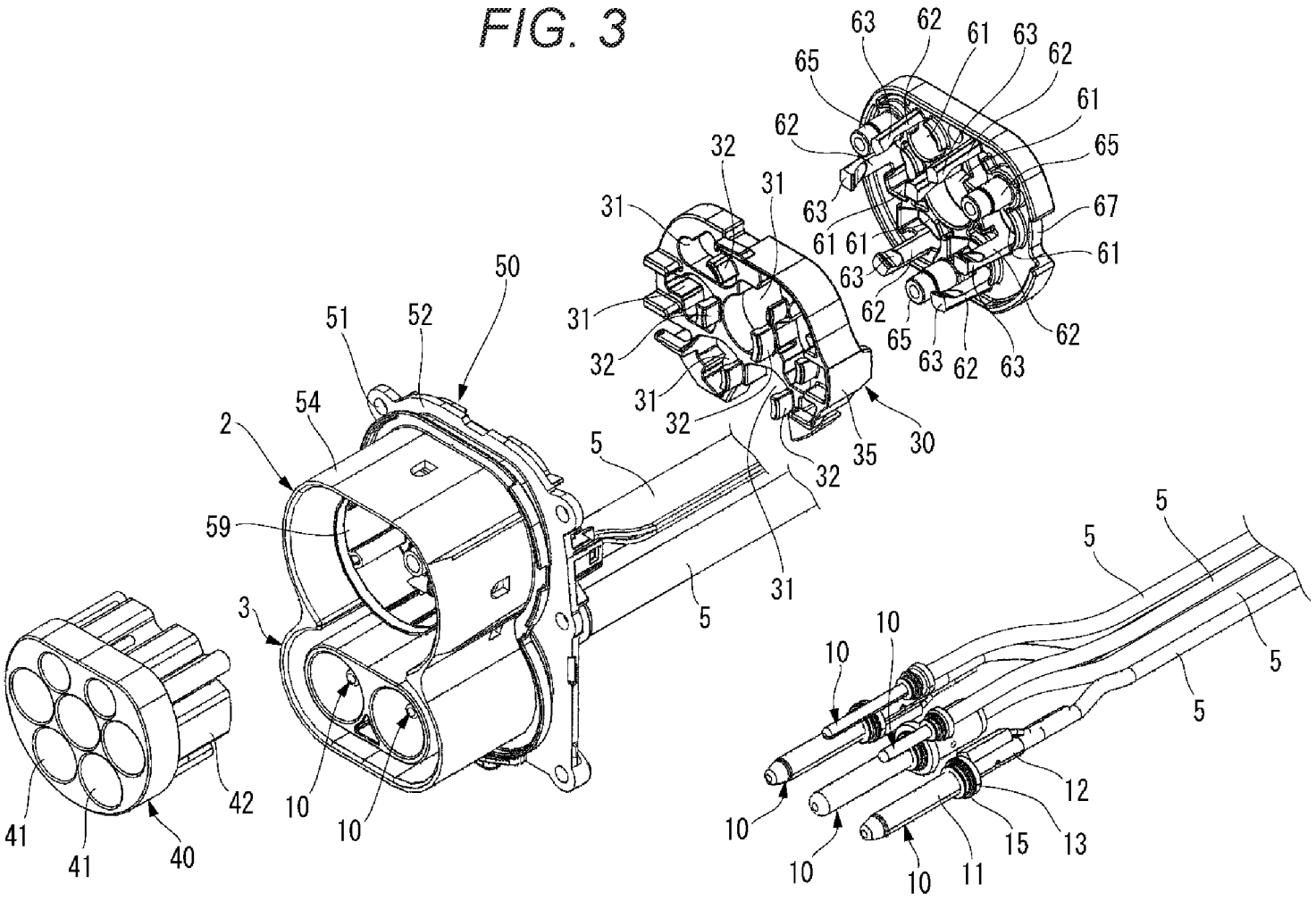
FIG. 3 is an exploded perspective view showing the connector.

Hereinafter, embodiments of the present invention will be described with reference to the drawings. FIG. 1 is a perspective view showing a connector according to the present embodiment as viewed from a front side. FIG. 2 is a perspective view showing the connector according to the present embodiment as viewed from a rear side. FIG. 3 is an exploded perspective view showing the connector.

As shown in FIGS. 1 to 3, the connector 1 according to the present embodiment is to be connected to end portions of a plurality of electric wires 5. Each of the electric wires 5 to which the connector 1 is to be connected is a power line, a ground line, a signal line, or the like. A mating connector (not shown) is to be connected to a front portion of the connector 1.

For example, the connector 1 can be suitably used in a power-reception-side connector attached on a vehicle, which serves as a charging connector. The connector according to the present invention may be used as a power-supply-side connector attached on a vehicle, too.

The connector 1 includes a first connector portion 2 and a second connector portion 3. Terminals 10 are attached to the first connector portion 2 and the second connector portion 3 from a rear side of the connector 1. Each of the terminals 10 to be connected to the electric wire 5 formed of, for example, a signal line is inserted and attached to the first connector portion 2, and each of the terminals 10 connected to the electric wire 5 formed of, for example, a power line is inserted and attached to the second connector portion 3.

The connector 1 includes the terminals 10, a housing 20, a retainer 30, and a front holder 40.

The terminals 10 are formed of a conductive metal material such as copper and a copper alloy, and are manufactured by cutting a round bar formed of the conductive metal material. The terminal 10 is provided with an electrical connection portion 11 at a front end side of the terminal 10 and an electric wire connection portion 12 at a rear end side of the terminal 10. The terminal 10 includes a flange portion 13 extending from the terminal 10 to an outer periphery (i.e., extending outward) and provided between the electrical connection portion 11 and the electric wire connection portion 12. The terminal 10 is attached to the housing 20 of the connector 1 from a rear side of the connector 1.

The housing 20 includes a front housing 50 and a rear housing 60. Each of the front housing 50 and the rear housing 60 is formed of a synthetic resin. The rear housing 60 is attached to a portion of the front housing 50 forming the first connector portion 2 from a rear side of the front housing 50 via the retainer 30. The front holder 40 is attached to the portion of the front housing 50 forming the first connector portion 2 from a front side of the front housing 50.

The front housing 50 includes an attachment flange 52 having a bolt hole 51. The attachment flange 52 protrudes from the front housing 50 toward an outer peripheral side of the front housing 50 (i.e., protrudes radially outward). A bolt (not shown) inserted into the bolt hole 51 of the attachment flange 52 is to be screwed into a screw hole (not shown) of a vehicle, such that the connector 1 is attached to the vehicle.

Figure 4:
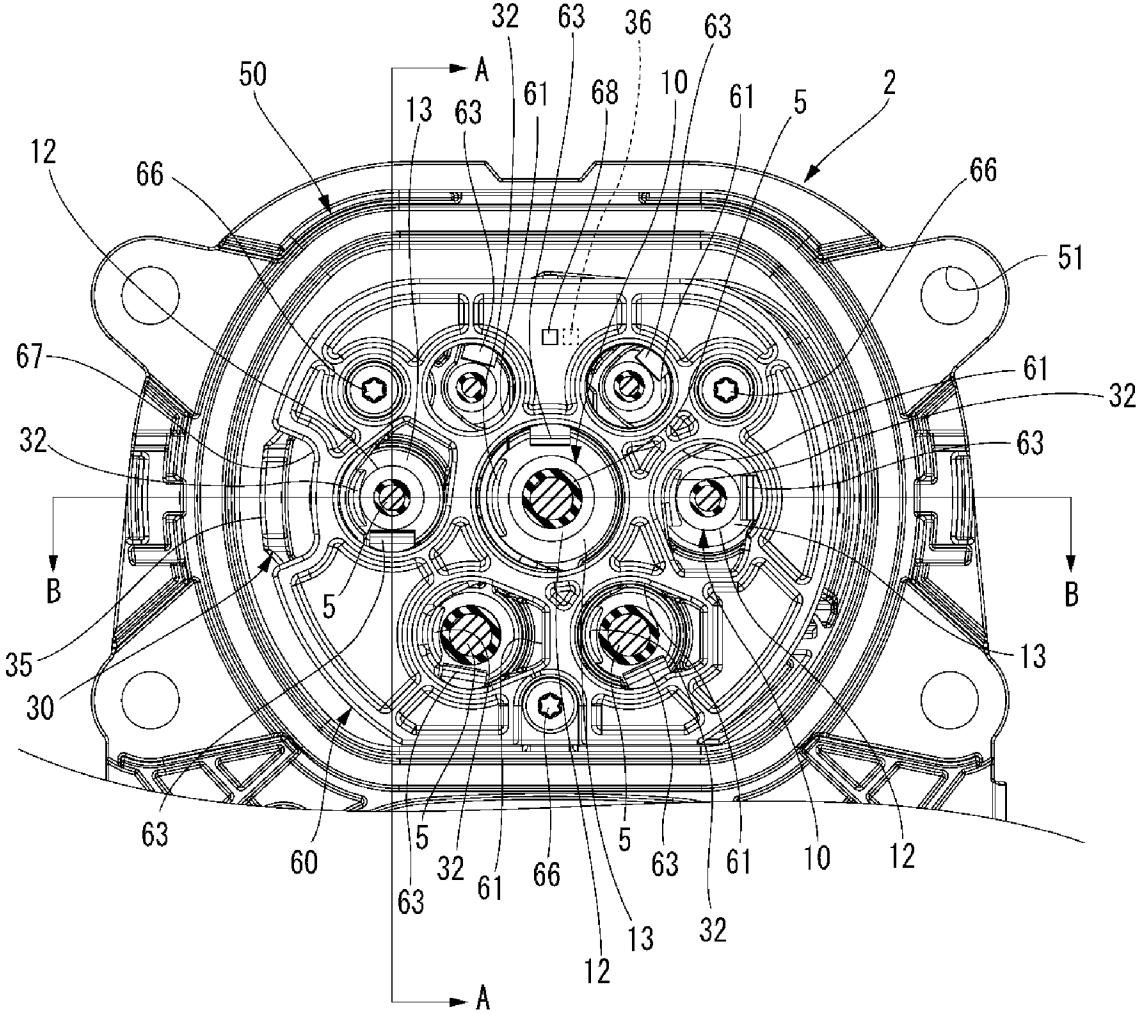
FIG. 4 is a front view showing a first connector portion of the connector as viewed from the rear side.
Figure 5:
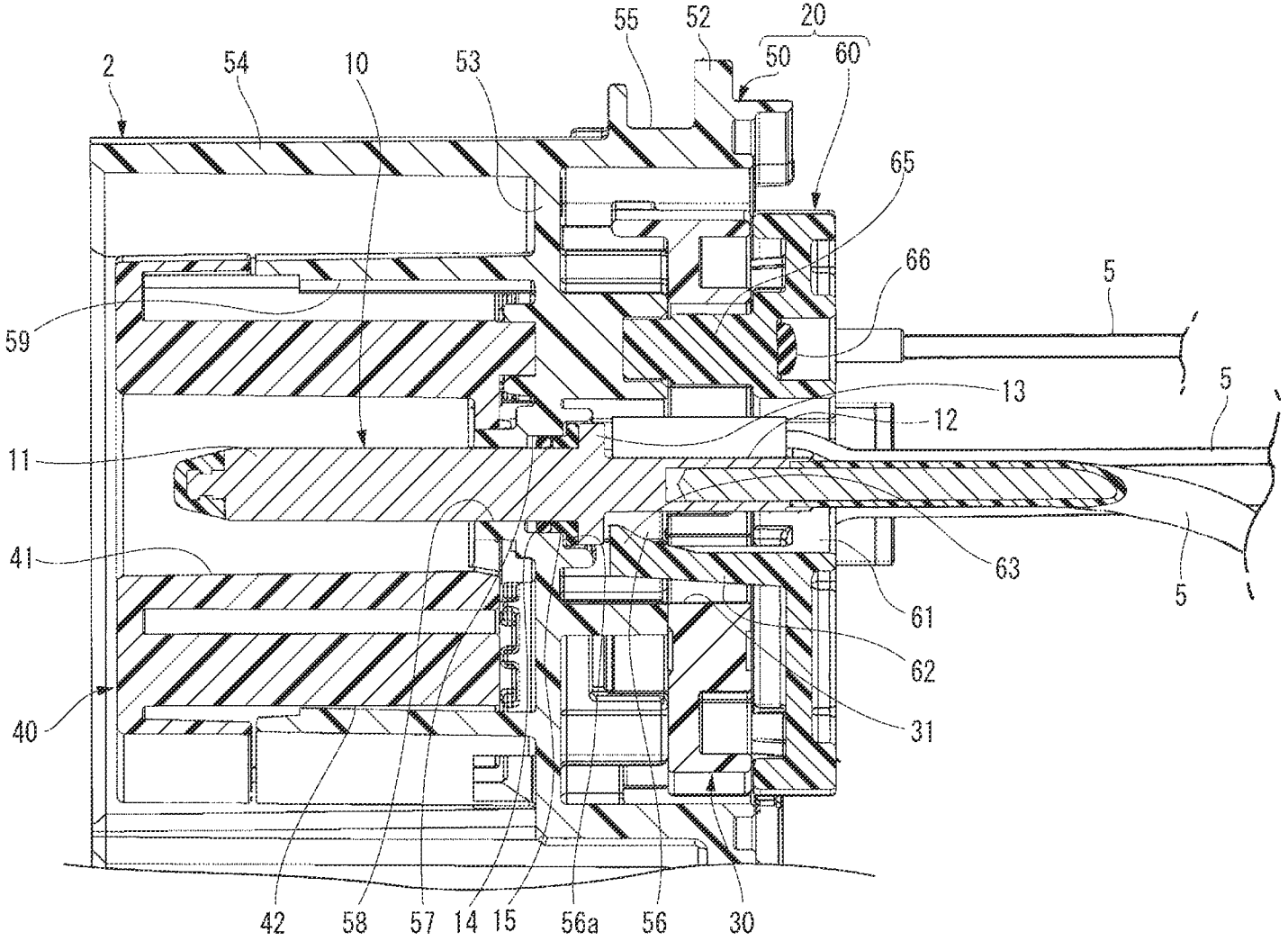
FIG. 5 is a cross-sectional view taken along a line A-A in FIG. 4.
Figure 6:
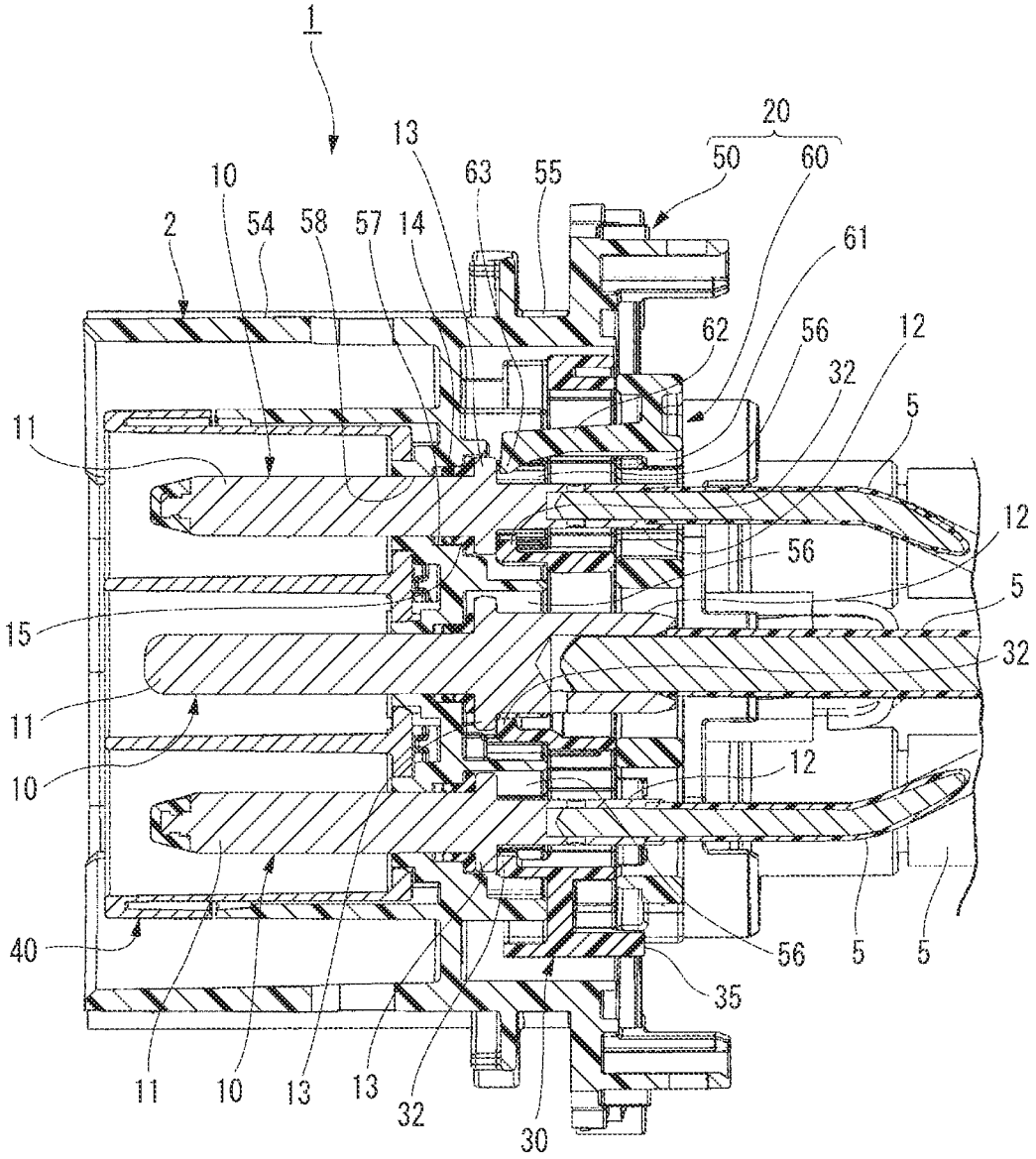
FIG. 6 is a cross-sectional view taken along a line B-B in FIG. 4.
Figure 7:
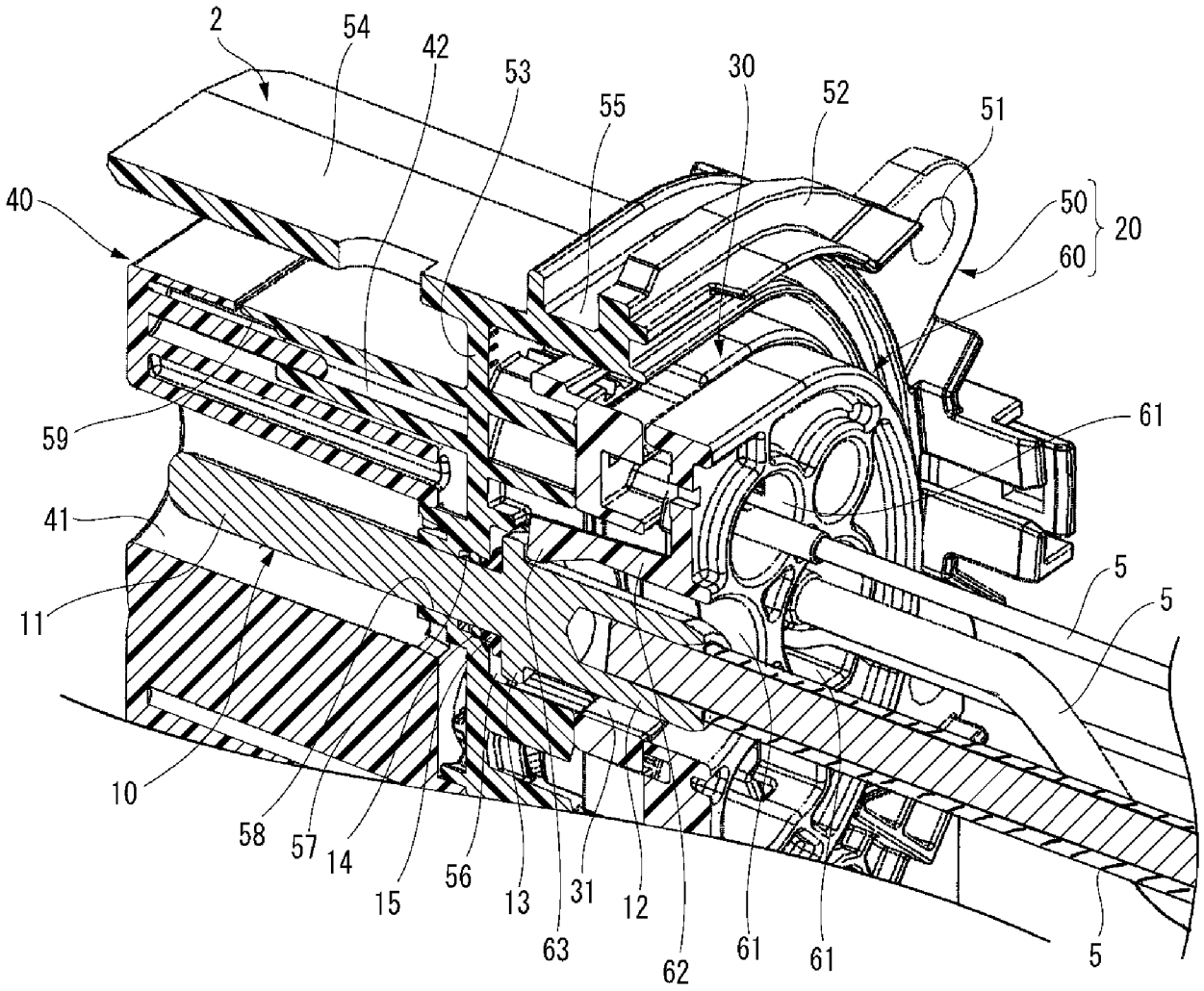

FIG. 4 is a front view showing the first connector portion of the connector as viewed from the rear side. FIG. 5 is a cross-sectional view taken along a line A-A in FIG. 4. FIG. 6 is a cross-sectional view taken along a line B-B in FIG. 4. FIG. 7 is a perspective view showing the connector cut along a longitudinal direction.

As shown in FIGS. 4 to 7, the front housing 50 is formed into a cylindrical shape. The front housing 50 includes a partition wall 53 at a rear side in an axial direction of the connector 1, and the partition wall 53 partitions an inside of the front housing 50 in a front-rear manner, i.e., the partition wall 53 divides an inner space of the front housing 50 into two, a front space and a rear space. Of the front housing 50, a portion at a front side than the partition wall 53 is a front peripheral wall 54, and a portion at a rear side than the partition wall 53 is a rear peripheral wall 55. In the front housing 50, the front holder 40 is attached inside the front peripheral wall 54 and the retainer 30 and the rear housing 60 are attached inside the rear peripheral wall 55.

A plurality of terminal accommodating chambers 56 are formed in the partition wall 53 of the front housing 50. The terminals 10 are inserted into the terminal accommodating chambers 56 from a rear side of the front housing 50. At a front side in an insertion direction of the terminal 10 (i.e., a direction in which the terminal 10 is inserted into the front housing 50), each of the terminal accommodating chambers 56 is provided with a seal hole 57 having a smaller diameter than the terminal accommodating chamber 56, and is further formed with a through hole 58 having a smaller diameter than the seal hole 57. Of the terminal 10 inserted into the terminal accommodating chamber 56, the electrical connection portion 11 is inserted into the through hole 58, and the flange portion 13 is locked by a bottom portion 56*a* of the terminal accommodating chamber 56 to restrict a forward movement of the terminal 10 (i.e., a movement of the terminal 10 in the insertion direction).

An annular seal member 15 and an O-ring 14 are attached to the terminal 10 to be inserted into the terminal accommodating chamber 56 at a base portion of the electrical connection portion 11, the base portion being connected to/in the vicinity of/near the flange portion 13. Accordingly, when the terminal 10 is inserted into the terminal accommodating chamber 56, the O-ring 14 is pushed into the seal hole 57 by the seal member 15, and the seal member 15 is interposed between the bottom portion 56*a* of the terminal accommodating chamber 56 and the flange portion 13. Accordingly, a space between the terminal accommodating chamber 56 and the terminal 10 inserted into the terminal accommodating chamber 56 is sealed by the O-ring 14.

The front housing 50 has a fitting recessed portion 59 inside the front peripheral wall 54. The fitting recessed portion 59 is formed further in the front side than the partition wall 53.

The rear housing 60 is formed into a plate shape having a plurality of communicating holes 61. The communicating holes 61 communicate with the terminal accommodating chambers 56 of the front housing 50 when the rear housing 60 is attached to the front housing 50.

The rear housing 60 has a plurality of lances 62. These lances 62 are formed integrally with respective edges of the communicating holes 61, and extend in an assembly direction to the front housing 50 (i.e., a direction in which the rear housing 60 is attached to the front housing). A locking claw 63 protruding toward the center of the communicating hole 61 is formed at a tip end portion of each of the lances 62.

The rear housing 60 has a plurality of cylindrical mounting bosses 65. The mounting bosses 65 extend in the assembly direction to the front housing 50. A screw 66 is to be inserted into each of the mounting boss 65 from a rear side of the rear housing 60. The screw 66 is to be screwed into a screw hole (not shown) formed in the partition wall 53 of the front housing 50. Accordingly, the rear housing 60 is attached into the rear peripheral wall 55 with a gap between the rear housing 60 and the partition wall 53 of the front housing 50.

The rear housing 60 has an outer shape that is smaller than an inner shape of the rear peripheral wall 55 of the front housing 50. When the rear housing 60 is attached to the front housing 50, a gap is formed between an outer peripheral surface of the rear housing 60 and an inner peripheral surface of the rear peripheral wall 55 in a circumferential direction. The rear housing 60 is formed with a recess 67 in a part of an outer periphery of the rear housing 60. The rear housing 60 is formed with a detection hole 68 that runs through a front surface and a rear surface of the rear housing 60.

The retainer 30 is formed of a synthetic resin, and is formed into a plate shape. The retainer 30 is disposed between the front housing 50 and the rear housing 60 when the rear housing 60 is attached to the front housing 50. Accordingly, the retainer 30 is disposed inside the rear peripheral wall 55 of the front housing 50, and is slidably supported with respect to the housing 20 including the front housing 50 and the rear housing 60 in a direction perpendicular to the insertion direction of the terminal 10. In other words, the retainer 30 is configured to be attached between the front housing 50 and the rear housing 60 and to be displaceable/movable along a direction perpendicular to the insertion direction between a locking position and a non-locking position.

The retainer 30 has a plurality of openings 31. The openings 31 communicate with the terminal accommodating chambers 56 of the front housing 50 and the communicating holes 61 of the rear housing 60. The lances 62 and the mounting bosses 65 of the rear housing 60 are inserted into the openings 31.

The retainer 30 has a plurality of locking portions 32. The locking portions 32 are formed integrally with respective edges of the openings 31, and protrude in an assembly direction to the front housing 50 (i.e., a direction in which the retainer 30 is attached to the front housing 50).

The retainer 30 has an outer shape that is substantially the same as the outer shape of the rear housing 60. The retainer 30 is formed with a detection protrusion 35 in a part of an outer periphery of the retainer 30. Further, the retainer 30 is formed with a check hole 36.

Figure 8A:
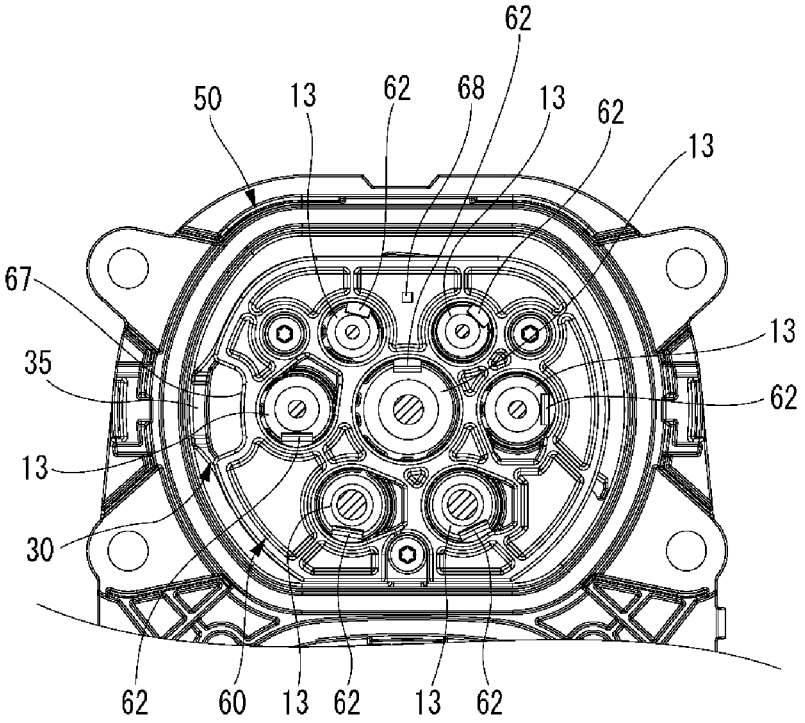
Figure 8B:
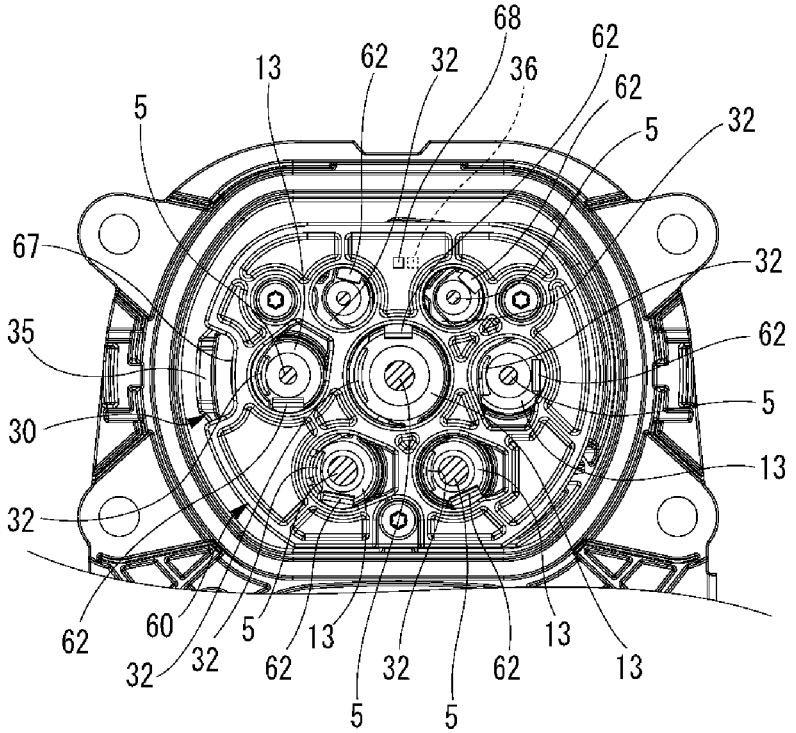

FIGS. 8A and 8B are views showing states of the retainer. FIG. 8A is a front view showing a state where the retainer is disposed at the non-locking position as viewed from a rear side of the first connector portion, and FIG. 8B is a front view showing a state where the retainer is disposed at the locking position as viewed from the rear side of the first connector portion.

As shown in FIGS. 8A and 8B, the retainer 30 that is slidably supported with respect to the housing 20 slides between the non-locking position and the locking position.

As shown in FIG. 8A, when the retainer 30 is disposed at the non-locking position, the locking portion 32 is disposed at a position outside the terminal accommodating chamber 56 of the front housing 50 and the communicating hole 61 of the rear housing 60. In a state where the retainer 30 is disposed at the non-locking position, the detection protrusion 35 is disposed outside the recess 67 of the rear housing 60 and is disposed in the gap between the rear peripheral wall 55 and the rear housing 60. Also the check hole 36 communicates with the detection hole 68 of the rear housing 60.

As shown in FIG. 8B, when the retainer 30 is disposed at the locking position, the locking portion 32 is disposed inside the terminal accommodating chamber 56 of the front housing 50 and the communicating hole 61 of the rear housing 60. In a state where the retainer 30 is disposed at the locking position, the detection protrusion 35 is disposed inside the recess 67 of the rear housing 60, and the check hole 36 is shifted from the detection hole 68 of the rear housing 60.

The front holder 40 is formed of a synthetic resin and has a plurality of accommodating holes 41. A rear portion of the front holder 40 is a fitting portion 42. The fitting portion 42 is fitted to the fitting recessed portion 59 of the front housing 50, thereby attaching the front holder 40 to the front housing 50 and disposing the front holder 40 inside the front peripheral wall 54. When the front holder 40 is attached to the front housing 50, the accommodating hole 41 communicates with the through hole 58 of the partition wall 53 of the front housing 50. Accordingly, the electrical connection portion 11 of the terminal 10 that has passed through the through hole 58 is accommodated in the accommodating hole 41 of the front holder 40.

Next, how the terminal 10 is attached to the housing 20 provided with the retainer 30 and the front holder 40 will be described.

To attach the terminal 10 to the housing 20, first, the retainer 30 is disposed in the non-locking position (see FIG. 8A). Accordingly, the locking portion 32 of the retainer 30 is disposed at a position outside the terminal accommodating chamber 56 of the front housing 50 and the communicating hole 61 of the rear housing 60.

In this state, the terminal 10 is inserted and pushed into the communicating hole 61 of the rear housing 60 from the rear side of the housing 20, and the electrical connection portion 11 is inserted through the through hole 58 of the front housing 50 and is accommodated in the terminal accommodating chamber 56. Then, each of the lances 62 of the rear housing 60 is elastically deformed by the locking claw 63 being pushed outward by the flange portion 13, and thereafter the lance 62 is restored when the flange portion 13 reaches to a front side of the locking claw 63. Accordingly, the flange portion 13 of the terminal 10 is locked by the locking claw 63 of the lance 62, a rearward movement in the insertion direction of the terminal 10 is restricted (i.e., a movement in a direction opposite to the insertion direction of the terminal 10), and the terminal 10 is prevented from coming off.

In this manner, when the terminal 10 is accommodated in the terminal accommodating chamber 56, the seal member 15 attached to the root of the electrical connection portion 11 connected to the flange portion 13 pushes the O-ring 14 into the seal hole 57, and the seal member 15 is interposed between the bottom portion 56*a* of the terminal accommodating chamber 56 and the flange portion 13. Accordingly, a space between the terminal 10 and the terminal accommodating chamber 56 is sealed by the O-ring 14.

Next, the retainer 30 disposed at the non-locking position slides to the locking position (see FIG. 8B). Then, each locking portion 32 of the retainer 30 comes to a rear side of the flange portion 13 of the terminal 10 accommodated in the terminal accommodating chamber 56. Accordingly, the flange portion 13 of the terminal 10 is locked at two positions by the lance 62 of the rear housing 60 and the locking portion 32 of the retainer 30.

As described above, according to the connector 1 in the present embodiment, when the retainer 30 moves from the non-locking position to the locking position, the terminal 10 can be locked by the locking portion 32 of the retainer 30 and the lance 62 of the rear housing 60. Compared with a case where the terminal 10 is locked by the lance 62 only, according to the connector 1 in the present embodiment, the terminal 10 can be locked in a well-balanced manner, and inclination of the terminal 10 due to a biasing force can be prevented. Further, the rear housing 60 is provided with the lance 62, so that a lance of the front housing 50 is not necessary, and a structure can be simplified. Accordingly, a cost and a size can be reduced. Since a hole for removing a mold for molding a lance in the front housing is not formed in the front housing 50, good sealing performance of the front housing 50 can be ensured.

The front housing 50 has the rear peripheral wall 55 that surrounds the retainer 30. Accordingly, a periphery of the retainer 30 attached between the front housing 50 and the rear housing 60 is covered by the rear peripheral wall 55 of the front housing 50, so that the retainer 30 can be protected, and an erroneous operation due to careless contact with the retainer 30 can be prevented.

The retainer 30 has a detection protrusion 35 protruding from an outer peripheral surface of the rear housing 60 in a radial direction of the connector when the retainer 30 is at the non-locking position. In other words, the retainer 30 has the detection protrusion 35 configured to, when the retainer 30 is disposed at the non-locking position, be disposed above/at an outer side of the outer peripheral surface of the rear housing 60 in the radial direction of the connector in a protruding manner. Therefore, a locking state of the terminal 10 by the locking portion 32 of the retainer 30 can be easily confirmed by visually checking a protruding state of the detection protrusion 35 of the retainer 30 on the outer peripheral surface of the rear housing 60. For example, when a cover configured to cover an outer periphery of the rear housing 60 is attached, a locking state of the terminal 10 by the locking portion 32 of the retainer 30 can be easily confirmed by checking whether the cover interferes with the detection protrusion 35.

Further, the rear housing 60 is formed with the detection hole 68, and the retainer 30 is formed with the check hole 36 that communicates with the detection hole 68 of the rear housing 60 in a state where the retainer 30 is disposed at the non-locking position. Therefore, a locking state of the terminal 10 by the locking portion 32 of the retainer 30 can be easily confirmed by inserting an inspection pin into the detection hole 68 and checking a length of an inserted part of the inspection pin. In addition, a locking state of the terminal 10 by the locking portion 32 of the retainer 30 can also be easily confirmed by visually checking whether the check hole 36 of the retainer 30 communicates with the detection hole 68.

When the retainer 30 is disposed at the locking position, the detection protrusion 35, which had been disposed above the outer peripheral surface of the rear housing 60 in the radial direction in a protruding manner when the retainer 30 was at the non-locking position, is accommodated within the recess 67 of the rear housing 60. Therefore, an operator can easily confirm a locking state of the terminal 10 by the locking portion 32 of the retainer 30 by visually checking whether the detection protrusion 35 of the retainer 30 is disposed in a protruding manner or not above the outer peripheral surface of the rear housing 60. Also, when a cover configured to cover the outer periphery of the rear housing 60 is attached, the operator can also easily confirm a locking state of the terminal 10 by the locking portion 32 of the retainer 30 by checking whether the cover interferes with the detection protrusion 35 or not.

Further, when the retainer 30 is disposed at the locking position, the check hole 36 is disposed at a position shifted from the detection hole 68 of the rear housing 60. Therefore, an operator can easily confirm a locking state of the terminal 10 by the locking portion 32 of the retainer 30 by inserting an inspection pin into the detection hole 68 and checking the length of the inserted part/protruding part of the inspection pin. In addition, the operator can easily confirm a locking state of the terminal 10 by the locking portion 32 of the retainer 30 by visually checking whether the check hole 36 of the retainer 30 communicates with the detection hole 68.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

According to an aspect of the embodiments described above, a connector includes a terminal (10), a housing (20) configured to accommodate the terminal (10) and a retainer (30) including a locking portion (32) configured to lock the terminal (10) when the terminal (10) is accommodated in the housing (20). The housing (20) includes a front housing (50) having a terminal accommodating chamber (56) into which the terminal (10) is configured to be inserted and in which the terminal (10) is to be accommodated and a rear housing (60) configured to be attached to the front housing (50) from a rear side of an insertion direction in which the terminal (10) is inserted into the terminal accommodating chamber (56), the rear housing (60) including a lance (62) configured to, when the terminal (10) is accommodated in the terminal accommodating chamber (56), lock a rear portion of the terminal (10) in the insertion direction. The retainer (30) is configured to be attached between the front housing (50) and the rear housing (60) and to be displaceable along a direction perpendicular to the insertion direction between a locking position and a non-locking position. The retainer (30) moves from the non-locking position to the locking position, and the locking portion (32) locks the rear portion of the terminal (10) in the insertion direction accommodated in the terminal accommodating chamber (56).

According to the connector having the above described configuration, when the retainer moves from the non-locking position to the locking position, the terminal can be locked by the locking portion of the retainer and the lance of the rear housing. Compared with a case where the terminal is locked by the lance only, the terminal can be locked in a well-balanced manner, and inclination of the terminal due to a biasing force can be prevented. Further, the rear housing is provided with the lance, so that a lance of the front housing is not necessary, and a structure can be simplified. Accordingly, a cost and a size can be reduced. Since a hole for removing a mold for molding a lance in the front housing is not formed in the front housing, good sealing performance of the front housing can be ensured.

The front housing (50) may have a peripheral wall (rear peripheral wall 55) which surrounds the retainer (30) when the retainer (30) is attached to the front housing (50).

According to the connector having the above described configuration, since a peripheral surface of the retainer attached between the front housing and the rear housing is covered by the peripheral wall of the front housing, the retainer can be protected, and an erroneous operation due to careless contact with the retainer can be prevented.

The retainer (30) may have a detection protrusion (35) protruding from an outer peripheral surface of the rear housing (60) in a radial direction of the connector when the retainer (30) is at the non-locking position.

According to the connector having the above described configuration, a locking state of the terminal by the locking portion of the retainer can be easily confirmed by visually checking a protruding state of the detection protrusion of the retainer from the outer peripheral surface of the rear housing. Also, when a cover configured to cover an outer periphery of the rear housing is attached, a locking state of the terminal by the locking portion of the retainer can be easily confirmed by checking whether the cover interferes with the detection protrusion.

The rear housing (60) may be formed with a detection hole (68). The retainer (30) may be formed with a check hole (36) configured to, when the retainer (30) is at the non-locking position, communicate with the detection hole (68) of the rear housing (60).

According to the connector having the above described configuration, the check hole of the retainer communicates with the detection hole of the rear housing in a state where the retainer is disposed at the non-locking position. Therefore, a locking state of the terminal by the locking portion of the retainer can be easily confirmed by inserting an inspection pin into the detection hole and checking an insertion length of the inspection pin. In addition, a locking state of the terminal by the locking portion of the retainer can be easily confirmed by visually checking whether the check hole of the retainer communicates with the detection hole.

What is claimed is:

1. A connector including:

a terminal;

a housing configured to accommodate the terminal; and a retainer including a locking portion configured to lock the terminal when the terminal is accommodated in the housing;

wherein the housing includes:

a front housing having a rear peripheral wall and a terminal accommodating chamber into which the terminal is configured to be inserted and in which the terminal is to be accommodated; and a rear housing configured to be attached to the front housing from a rear side of an insertion direction in which the terminal is inserted into the terminal accommodating chamber, the rear housing including a lance configured to, when the terminal is accommodated in the terminal accommodating chamber, lock a rear portion of the terminal in the insertion direction, wherein the rear housing has an outer shape that is smaller than an inner shape of the rear peripheral wall of the front housing, such that when the rear housing is attached to the front housing, a gap is formed between an outer peripheral surface of the rear housing and an inner peripheral surface of the rear peripheral wall in a circumferential direction, wherein the retainer is configured to be attached between the front housing and the rear housing and to be displaceable along a direction perpendicular to the insertion direction between a locking position and a non-locking position, and wherein the retainer moves from the non-locking position to the locking position and the locking portion locks the rear portion of the terminal in the insertion direction accommodated in the terminal accommodating chamber.

2. The connector according to claim 1, wherein the front housing has a peripheral wall which surrounds the retainer when the retainer is attached to the front housing.

3. The connector according to claim 1, wherein the retainer has a detection protrusion protruding from an outer peripheral surface of the rear housing in a radial direction of the connector when the retainer is at the non-locking position.

4. The connector according to claim 1, wherein the rear housing is formed with a detection hole, and wherein the retainer is formed with a check hole configured to, when the retainer is at the non-locking position, communicate with the detection hole of the rear housing.

* * * * *